US007819094B2

(12) United States Patent
Knab et al.

(10) Patent No.: US 7,819,094 B2
(45) Date of Patent: Oct. 26, 2010

(54) FAN SYSTEM AND A METHOD FOR CONTROLLING A FAN MOTOR

(75) Inventors: Norbert Knab, Appenweier (DE); Richard Vogt, Willstaett (DE); Nikolas Haberl, Sinzheim (DE)

(73) Assignee: Robert Bosch GmbH, Stuttgart (DE)

( * ) Notice: Subject to any disclaimer, the term of this patent is extended or adjusted under 35 U.S.C. 154(b) by 424 days.

(21) Appl. No.: 11/910,542

(22) PCT Filed: Feb. 13, 2006

(86) PCT No.: PCT/EP2006/050876

§ 371 (c)(1),
(2), (4) Date: Oct. 3, 2007

(87) PCT Pub. No.: WO2006/108728

PCT Pub. Date: Oct. 19, 2006

(65) Prior Publication Data

US 2009/0266313 A1 Oct. 29, 2009

(30) Foreign Application Priority Data

Apr. 11, 2005 (DE) ..... 10 2005 016 452

(51) Int. Cl.
*F01P 7/10* (2006.01)

(52) U.S. Cl. ..... 123/41.49; 123/41.11

(58) Field of Classification Search ..... 123/41.11, 123/41.12, 41.48, 41.49
See application file for complete search history.

(56) References Cited

U.S. PATENT DOCUMENTS

| | | | | |
|---|---|---|---|---|
| 4,378,760 | A | 4/1983 | Barge | |
| 2002/0195069 | A1 | 12/2002 | Herke et al. | |
| 2004/0113573 | A1 | 6/2004 | McCauley et al. | |
| 2006/0004501 | A1 * | 1/2006 | Volkening et al. | 701/36 |

FOREIGN PATENT DOCUMENTS

| | | |
|---|---|---|
| JP | 02188144 | 7/1990 |

OTHER PUBLICATIONS

PCT/EP2006/050876 International Search Report, dated Jun. 23, 2006.

* cited by examiner

*Primary Examiner*—Noah Kamen
(74) *Attorney, Agent, or Firm*—Michael Best & Friedrich LLP

(57) ABSTRACT

The invention relates to a fan system for a controllably cooling a vehicle internal combustion engine comprising an electric fan motor and a control unit for controlling said fan motor, wherein said control unit controls the fan motor according to a regulation correcting variable dependent on a desired cooling power, the control unit is constructed in such a way that it controls the fan motor independently of the desired cooling power at a determined moment with a regulation-correcting variable increased with respect to a correcting variable for a predetermined space of time.

10 Claims, 2 Drawing Sheets

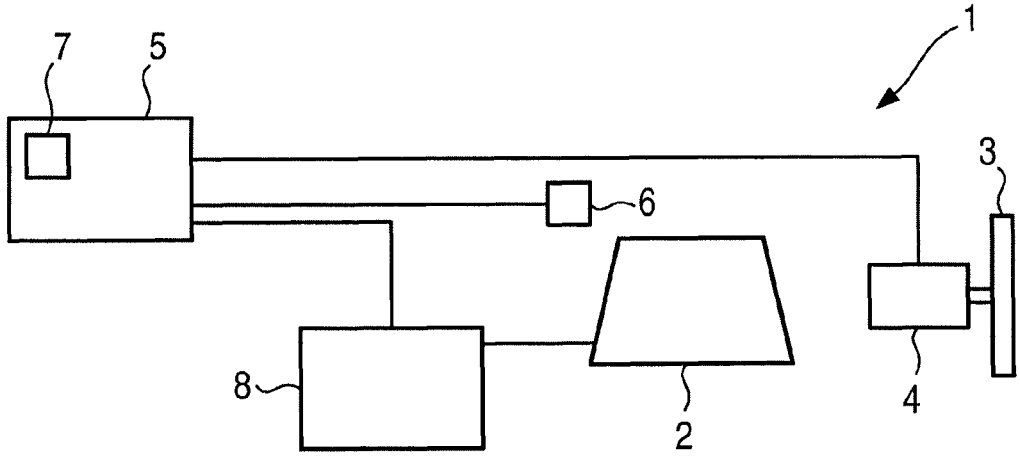
Fig. 1
Fig. 2
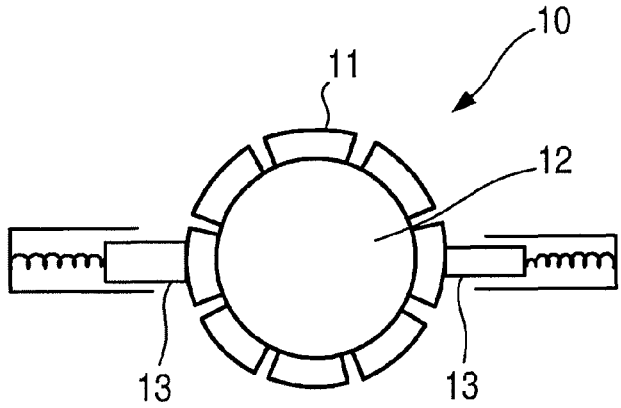

FAN SYSTEM AND A METHOD FOR CONTROLLING A FAN MOTOR

BACKGROUND OF THE INVENTION

The invention relates to a fan system and a method for controlling a fan motor.

The invention relates to a fan system for the regulated cooling of an internal combustion engine of a motor vehicle. In the invention relates further to a method for controlling a fan motor.

Fan motors in engine cooling fans are normally triggered almost continuously variably by high-frequency cycle regulators (so-called FCMs or fan control modules). Among other things, this makes it possible to coordinate the fan power with the actual cooling demand. The cycle regulator itself is normally triggered with the aid of a low-frequency pulse-width modulation signal in the range of approx. 5 to 300 Hz, which specifies the degree of triggering for the fan motor.

A fan system for conducting regulated cooling for an internal combustion engine in a motor vehicle is designed for a cooling air demand at very high ambient temperatures and high cooling demand of the internal combustion engine. Normally, a fan motor for this type of fan system features power in the range of 300 to 600 W. The cycle regulators are designed correspondingly and are used to trigger the fan motors in a suitable manner so that the desired cooling power is provided.

The fan motor is normally triggered with frequencies above 18 kHz.

Although, as a rule, fan motors must be designed for high maximum required cooling power in order to be able to make the required cooling power available under extreme operating conditions, the fan motors are charged only with a clearly lower power and therefore with a lower current for a majority of the overall operating time in normal operation.

As a rule, a fan motor has a commutator via which the rotor coils of the fan motor can be energized with the aid of contact brushes. In the case of long-lasting triggering by current that is too low and with a fan motor rpm that is too low, the commutator normally "gets pasty," i.e., carbon dust, dirt, oil, etc. gets deposited in the slots between the commutator's contact lamellae, whereby the pastiness from the carbon dust is frequently conductive and therefore causes a short circuit or reduced resistance between the lamellae.

SUMMARY OF THE INVENTION

As a result, the objective of the present invention is preventing or reducing pastiness in the commutator of the fan motor in a fan system for conducting regulated cooling for an internal combustion engine. In addition, the objective of the present is making available a method for triggering a fan motor with which a pastiness of the commutator of the fan motor can be avoided or reduced.

Additional embodiments of the invention are disclosed in the subordinate claims.

According to a first aspect of the present invention, a fan system for conducting regulated cooling for an internal combustion engine is provided. The fan system has an electric fan motor and a control unit for triggering the fan motor. The control unit triggers the fan motor with a regulation control variable as a function of a desired cooling power.

According to the invention the control unit is constructed in such a way that it triggers the fan motor at a specific point in time independent of the desired cooling power with a cleaning control variable that is increased with respect to the regulation control variable for a predetermined period of time. The advantage of the fan system of the present invention is that it exits the regulation of the triggering of the fan motor at a specific point in time and triggers the fan motor with a "cleaning" control variable, which is greater than the regulation control variable. The increased triggering of the motor by the cleaning control variable for the predetermined period of time can keep a commutator in the fan motor from getting pasty or reduce or eliminate already existing pastiness. This is achieved by two effects that are essentially independent of one another. For one, the increased centrifugal force with an increased rpm of the fan motor causes the pastiness between the commutator's contact lamellae to be cast out. Secondly, the increased flow of current due to increased triggering of the fan motor by the cleaning control variable causes the flow of current between the commutator's lamellae to increase because of the reduced electrical resistance of an already existing pastiness, whereby the pastiness vaporizes, burns off or is removed by other effects. Since this type of pastiness arises in particular in the case of longer lasting operation at low rpm ranges or a low triggering current, the triggering of the fan motor in accordance with the invention by the cleaning control variable at a specific point in time counteracts this type of pastiness.

According to one embodiment of the invention, the control unit can trigger the fan motor at regular time intervals independent of the desired cooling power with the with respect to the cleaning control variable for the predetermined period of time.

This represents a very simple way of avoiding the pastiness of the fan motor over a great operating time period.

The regular time intervals are preferably between one operating hour and multiple tens of operating hours.

According to one embodiment of the invention, the control unit can be constructed in such a way that it triggers the fan motor with the cleaning control variable only if a predetermined normal operating duration in the case of triggering by a regulation control variable has passed after a preceding triggering by the cleaning control variable, and if the motor vehicle is moving at a speed greater than the minimum speed and/or the rpm of the internal combustion engine is greater than a minimum rpm. In this way, it is possible to prevent the vehicle from being triggered at a standstill, when the increased running noise of the fan motor triggered by the cleaning control variable represents ambient noise pollution under some circumstances. As a result, provisions are made for a decision to be made, based on the information available in the engine control about the operating state of the motor vehicle, whether or not the fan motor should be triggered by the increased cleaning control variable.

According to another embodiment of the invention, the control unit can be constructed in such a way that it triggers the fan motor with the cleaning control variable at the predetermined point in time only if the regulation control variable triggers the fan motor with a power, which is less than a predetermined proportion of a maximum cooling power, with which the fan motor can be triggered. In this way, it is assured that if maximum cooling power is already being accessed from the fan motor, the regulation of the fan motor is not interrupted in order to apply the cleaning control variable since in this case the triggering of the fan motor by the regulation control variable is already preventing or reducing the pastiness of the fan motor.

According to another aspect of the present invention, a method is provided for controlling a fan motor for an internal combustion engine of a motor vehicle. The fan motor is triggered with a regulation control variable independent of a desired cooling power. In addition, the fan motor is triggered at a specific point in time independent of the desired cooling power with a cleaning control variable that is increased with respect to the regulation control variable for a predetermined period of time.

The fan motor can be triggered at regular time intervals independent of the desired cooling power by the cleaning control variable for the predetermined period of time.

According to another embodiment of the invention, the fan motor can be triggered by the cleaning control variable only if a predetermined normal operating duration has passed after a preceding triggering by the increased control variable and if the motor vehicle is in a specific operating state, particularly if the motor vehicle is moving at a speed greater than a minimum speed and/or the rpm of the internal combustion engine is greater than a minimum rpm.

According to another embodiment of the invention, the fan motor can be triggered by the cleaning control variable at the predetermined point in time only if the regulation control variable triggers the fan motor with a power, which is less than a predetermined proportion of a maximum cooling power, with which the fan motor can be triggered.

BRIEF DESCRIPTION OF THE DRAWINGS

Preferred exemplary embodiments will be explained in greater detail in the following on the basis of the enclosed drawings. The drawings show:

FIG. 1 A schematic block diagram of a fan system for an internal combustion engine FIG. 2 A schematic representation of a commutator of the fan motor FIG. 3 A signal diagram, which qualitatively represents a progression of the control variable for triggering the fan motor for an embodiment of the invention

DETAILED DESCRIPTION

Figure 3:
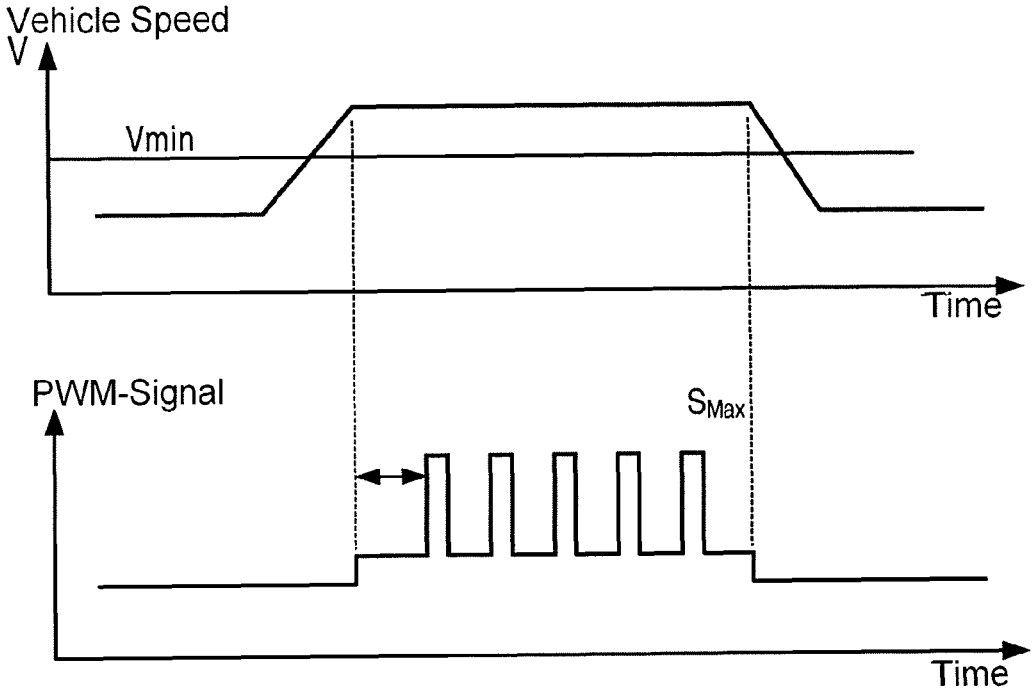

FIG. 1 schematically depicts a fan system 1 for an internal combustion engine 2 in a motor vehicle (not shown) as a block diagram. The fan system 1 has a fan blower 3 with a fan motor 4. The fan motor 4 is electrically connected to the control unit 5, which triggers the fan motor 4 continuously variably in a suitable manner with a control variable. The triggering of the fan motor takes place in this exemplary embodiment with the aid of pulse-width modulated signals with a frequency above 18 kHz. Other possibilities and methods for triggering the fan motor, whereby the fan motor is triggered continuously variably or in several stages, are also possible. The control variable is normally a voltage or a current, which is made available as a PWM signal or continuously.

Triggering the fan motor is undertaken in accordance with a previously determined required cooling power for the internal combustion engine 2. In this exemplary embodiment, the required cooling power is derived from the temperature of the internal combustion engine 2, which is determined with the aid of temperature sensor 6 that is normally arranged in the water circulation in the proximity of the internal combustion engine 2 and connected to the control unit 5.

The fan blower 3, in particular the fan motor 4, is designed in order to make high maximum cooling power for the internal combustion engine 2 available. However, this high cooling power is only accessed in exceptional cases, i.e., under extreme loads and heat generation in the internal combustion engine 2. As a result, in normal cooling operation, the control unit 4 triggers the fan motor 4 in such a way that a normally considerably lower cooling power is produced.

The result of this is that the fan motor 4 rotates at a considerably lower rpm than the maximum rpm, and that only a lower current (with respect to the maximum current) is applied to the fan motor 4. The consequence of this is that a commutator of the fan motor 4 can get pasty, i.e., the slots between commutator's lamellae are filled with carbon dust, dirt, oil and other substances, thereby diminishing the electric resistance between the commutator's lamellae and reducing the efficiency of the fan motor 4 or under some circumstances even generating a short circuit between the commutator's lamellae, which can damage the fan system.

This type of commutator is depicted schematically in FIG. 2, which shows the commutator 10, on which eight contact lamellae 11 are arranged (the number of contact lamellae of eight is arbitrary), which are arranged in an electrically insulated manner on a shaft 12. The contact lamellae 11 are connected electrically to rotor coils of the fan motor. Situated between the contact lamellae 11 are slots, which serve to electrically insulate the contact lamellae 11 against one another other. The lamellae 11 are contacted with the aid of so-called brushes 13, which are pressed against the lamellae 11 by spring force so that a constant contact exists between the brushes 13 and the lamellae 11. An electrical current reaches the rotor coils of the fan motor 2 via the brushes 13.

When the motor is in operation, the brushes 13 glide on the lamellae 11 and cause abrasion for example, which is deposited as dust preferably in the slots between the lamellae 11. Since the material of the brushes 13 is conductive, the abraded material that is deposited between the lamellae 11 is also conductive. In addition, dirt, oil and other materials located in the direct vicinity also get deposited between the lamellae 11. As a result, a paste forms between the lamellae 11 from a mixture of different materials; this paste is essentially conductive and therefore reduces the resistance between two lamellae 11 or generates a short circuit between two adjacent lamellae. This effect is undesirable since it prevents the proper triggering of the fan motor 4 and under some circumstances can lead to a malfunction or destruction of the fan motor.

To counteract this effect, it is necessary to operate the fan motor at least temporarily at a high rpm (in a range between 70% to 100% of the maximum rpm) or at a maximum rpm so that the pastiness between the lamellae 11 is cast out via centrifugal forces and/or to trigger the fan motor in such a way that the current for the triggering gets so great (preferably between 70% to 100% of the maximum current) that such a high current flows through the pastiness between two adjacent lamellae 11 that the pastiness is vaporized, burned off or removed by another effect. The spaces between the lamellae 11 can be cleaned by this.

Since, during normal operation of the fan system, the fan motors are triggered for the most part with a control variable that corresponds to a lower rpm and a lower triggering current, it is necessary to apply an increased cleaning control variable, e.g., an increased triggering voltage or triggering current, to the fan motor at one or more predetermined points in times in order to avoid or reduce the pastiness between the commutator's lamellae 11. The time duration, during which the cleaning control variable is applied, should be selected in such a way that it is adequate to remove an existing pastiness between the lamellae 11. Normally, the time duration, during which the control variable is applied, is in a range of minutes to several hours. The time duration, during which the cleaning control variable is applied to the fan motor, can also be a function of a pastiness measured variable determined by a status detector 7 in the control unit 5, whereby the pastiness measured variable is a measure for the existing pastiness of the commutator.

The cleaning control variable can for example be selected in such a way that the fan motor can be operated with a cooling power preferably in a cooling power range of 70 to 100% of the maximum cooling power, preferably at the maximum cooling power.

The points in time at which the control unit 5 triggers the fan motor 4 independent of the desired cooling power (e.g., prescribed by the temperature of the internal combustion engine 2) with the cleaning control variable can, for example, be preset by an interval timer, which triggers the fan motor with the cleaning control variable at regular intervals of time. The regular intervals of time can for example be between one operating hour and multiple tens of operating hours of the internal combustion engine 2.

In particular, the control unit 5 can trigger the fan motor 4 with the cleaning control variable only if a predetermined normal operating duration has passed after a preceding triggering by the cleaning control variable, while the fan motor is being operated with the regulation control variable in accordance with normal operation as a function of the desired cooling power. In addition, in the case of this exemplary embodiment, the fan motor 4 can be triggered with the cleaning control variable after the predetermined normal operating duration only if the motor vehicle in which the internal combustion engine 2 is located is in a specific operating state in which increased ambient noise is present. Such an operating state occurs for example if the motor vehicle is moving at a speed that is greater than a minimum speed and/or if the rpm of the internal combustion engine 2 is greater than a minimum rpm. The information about the speed of the vehicle or about the rpm of the internal combustion engine 2 can be provided to the control unit 5 by an engine control 8. The speed of the vehicle or the rpm of the internal combustion engine are used in this exemplary embodiment as a dimensional value for the ambient noise of the vehicle so that the fan motor is only triggered with the cleaning control variable if the ambient noise of the vehicle is increased by a higher speed or a higher rpm of the internal combustion engine 2. This reduces ambient noise pollution via the increasingly triggered fan motor 4.

This type of operating behavior is depicted in the signal time diagram shown in FIG. 3. The upper part of the diagram shows the vehicle speed plotted with the time and the lower part of the diagram shows the control variable for triggering the fan motor 4. It is evident that the fan motor is cyclically triggered with a maximum control variable $S_{max}$ only if the vehicle is moving at a speed that is above the minimum speed $V_{min}$.

According to another exemplary embodiment of the invention, normal operation of the fan motor, i.e., regulation of the fan motor 4, as a function of a temperature of the internal combustion engine 2 is only exited if the regulation control variable for triggering the fan motor 4 in normal operation produces a cooling power, which is less than a predetermined proportion of a maximum cooling power, with which the fan motor can be triggered. Because of this, the fan system does not have to exit the normal operation of regulating the fan motor as a function of the cooling power demand if the fan motor is being triggered in any case with a regulation control variable, which produces a sufficiently high rpm and a sufficient high triggering control, via which pastiness of the commutator of the fan motor 4 is avoided or reduced. The predetermined proportion of the maximum cooling power can be between 50 and 100%, preferably 70%.

The invention claimed is:

1. Fan system (1) for conducting regulated cooling for an internal combustion engine (2) in a motor vehicle comprising an electric fan motor (4) and a control unit (5) for triggering the fan motor, wherein said control unit (5) triggers the fan motor with a regulation control variable as a function of a desired cooling power, characterized in that the control unit (5) is constructed in such a way that it triggers the fan motor (4) at a specific point in time independent of the desired cooling power with a cleaning control variable that is increased with respect to the regulation control variable for a predetermined period of time, and characterized in that the control unit (5) is constructed in such a way that it triggers the fan motor (4) with the cleaning control variable only if a predetermined normal operating duration has passed after a preceding triggering by the increased control variable and if the motor vehicle is in a specific operating state, the specific operating state being the motor vehicle is moving at a speed greater than a minimum speed and/or the rpm of the internal combustion engine is greater than a minimum rpm.

2. Fan system (1) according to claim 1, characterized in that the control unit (5) triggers the fan motor at regular time intervals independent of the desired cooling power with the with respect to the cleaning control variable for the predetermined period of time.

3. Fan system (1) according to claim 2, characterized in that the regular time intervals are between one operating hour and multiple tens of operating hours.

4. Fan system (1) according to claim 1, characterized in that the predetermined normal operating duration is between one operating hour and multiple tens of operating hours.

5. Fan system (1) according to claim 1, characterized in that the control unit (5) is constructed in such a way that it triggers the fan motor (4) with the cleaning control variable at the predetermined point in time only if the regulation control variable triggers the fan motor with a power, which is less than a predetermined proportion of a maximum cooling power, with which the fan motor can be triggered.

6. Fan system (1) according to claim 1, characterized in that the fan motor (4) has a commutator (10).

7. Fan system (1) according to claim 6, characterized in that the control unit (5) triggers the fan motor at regular time intervals independent of the desired cooling power with the with respect to the cleaning control variable for the predetermined period of time.

8. Fan system (1) according to claim 7, characterized in that the regular time intervals are between one operating hour and multiple tens of operating hours.

9. Fan system (1) according to claim 8, characterized in that the predetermined normal operating duration is between one operating hour and multiple tens of operating hours.

10. Fan system (1) according to claim 9, characterized in that the control unit (5) is constructed in such a way that it triggers the fan motor (4) with the cleaning control variable at the predetermined point in time only if the regulation control variable triggers the fan motor with a power, which is less than a predetermined proportion of a maximum cooling power, with which the fan motor can be triggered.

* * * * *